US009640854B2

(12) United States Patent
Nakagawa

(10) Patent No.: US 9,640,854 B2
(45) Date of Patent: May 2, 2017

(54) WIRELESS COMMUNICATION DEVICE

(71) Applicant: ALPS ELECTRIC CO., LTD., Ota-ku, Tokyo (JP)

(72) Inventor: Masashi Nakagawa, Tokyo (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/812,450

(22) Filed: Jul. 29, 2015

(65) Prior Publication Data

US 2016/0043463 A1 Feb. 11, 2016

(30) Foreign Application Priority Data

Aug. 6, 2014 (JP) ..... 2014-160517

(51) Int. Cl.

| | |
|---|---|
| ***H01Q 1/38*** | (2006.01) |
| ***H01Q 9/04*** | (2006.01) |
| ***H01Q 1/08*** | (2006.01) |
| ***H01Q 1/24*** | (2006.01) |
| ***H01Q 1/52*** | (2006.01) |
| ***H01Q 9/42*** | (2006.01) |

(52) U.S. Cl.

CPC ..... *H01Q 1/084* (2013.01); *H01Q 1/243* (2013.01); *H01Q 1/526* (2013.01); *H01Q 9/42* (2013.01)

(58) Field of Classification Search

CPC ..... H01Q 1/38; H01Q 9/04
USPC ..... 343/700 MS
See application file for complete search history.

(56) References Cited

U.S. PATENT DOCUMENTS

2007/0290944 A1* 12/2007 Takaki ..... H01Q 1/243 343/873
2014/0210675 A1* 7/2014 Hwang ..... H01Q 1/44 343/702

FOREIGN PATENT DOCUMENTS

JP 2003-298340 10/2003
JP 2010-258789 11/2010

* cited by examiner

*Primary Examiner* — Graham Smith
*Assistant Examiner* — Andrea Lindgren Baltzell
(74) *Attorney, Agent, or Firm* — Hunton & Williams LLP

(57) ABSTRACT

A wireless communication device includes a circuit board having a pattern formed on a surface thereof, a wireless communication main body configured to perform wireless communication, a shield cover configured to cover and shield the wireless communication main body arranged on the one surface of the circuit board, and an antenna connected to the wireless communication main body, in which the shield cover and the antenna include one metal plate, an attachment portion for attachment to a product, the antenna is an inverted F-antenna including an antenna main body, a feed portion, and a short-circuit portion, the short-circuit portion provided on one end side of the antenna and a top plate portion of the shield cover facing the wireless communication main body are connected by a short-circuit plate portion, and the feed portion is connected to a feed land formed on the surface of the circuit board.

4 Claims, 7 Drawing Sheets

WIRELESS COMMUNICATION DEVICE

CLAIM OF PRIORITY

This application contains subject matter related to and claims the benefit of Japanese Patent Application No. 2014-160517 filed on Aug. 6, 2014, the entire contents of which is incorporated herein by reference.

BACKGROUND OF THE DISCLOSURE

1. Field of the Disclosure

Embodiments of the present disclosure relate to a wireless communication device applied to a wireless communication system or the like.

2. Description of the Related Art

In recent years, with the development of wireless communication technology, various wireless communication devices with an antenna have been proposed. In the wireless communication devices, generally, a predetermined region in which a high-frequency circuit is arranged on one surface of a circuit board is covered by a metal shield cover, and a pattern antenna or the like is provided in another area of the one surface of the circuit board.

As such a wireless communication device, a wireless device 900 has been proposed in Japanese Unexamined Patent Application Publication No. 2010-258789. FIGS. 7A to 7C are views illustrating the wireless device 900 in an example of the related art. FIG. 7A is a perspective view illustrating the wireless device 900, FIG. 7B is a plan view illustrating one metal plate, and FIG. 7C is a perspective view illustrating a state in which a processed metal plate is mounted on a board 901.

In the wireless device 900, a wireless main body (not shown) is mounted on one surface of the board 901, and a shield case 903 that covers the wireless body and a sheet metal antenna 902 are arranged with a distance therebetween on one surface of the board 901, as illustrated in FIG. 7A. Further, the shield case 903 and the sheet metal antenna 902 are formed by processing one metal plate illustrated in FIG. 7B. That is, a connection body 905 in which the sheet metal antenna 902 and the shield case 903 are connected through connection portions 904 is formed from one metal plate and folded, and a portion of the sheet metal antenna 902 and a portion of the shield case 903 are mounted on the board 901 together in the form of this connection body 905, as illustrated in FIG. 7C. Also, the connection portions 904 are then cut and a state as illustrated in FIG. 7A is obtained.

Further, the sheet metal antenna 902 of the wireless device 900 is a so-called inverted F-antenna, and a ground conductor plate 912 forming a short-circuit portion is connected to the shield case 903 through a pattern (not shown) formed on the surface of the board 901.

However, in the wireless device 900 of the example of the related art, since the ground conductor plate (short-circuit portion) 912 of the inverted F-antenna (sheet metal antenna 902) is connected to a ground of the board 901 through the pattern arranged on the board 901 and connected to the shield case 903, there are problems in that the ground is not stable and antenna performance deteriorates.

These and other drawbacks exist.

SUMMARY OF THE DISCLOSURE

The embodiments of the present disclosure provide a wireless communication device with an antenna of which the ground is stabilized with a simple configuration.

According to an example embodiment, a wireless communication device includes: a circuit board having a pattern formed on a surface thereof; a wireless communication main body configured to perform wireless communication and arranged on one surface of the circuit board; a shield cover configured to cover and shield the wireless communication main body arranged on the one surface of the circuit board; and an antenna connected to the wireless communication main body, in which the shield cover and the antenna include one metal plate, an attachment portion for attachment to a product to which wireless communication device is applied is provided in the shield cover, the antenna is a inverted F-antenna including an antenna main body, a feed portion, and a short-circuit portion, the short-circuit portion provided on one end side of the antenna and a top plate portion of the shield cover facing the wireless communication main body are connected by a short-circuit plate portion, and the feed portion is connected to a feed land formed on the surface of the circuit board.

Accordingly, in a wireless communication device of the present embodiments, the short-circuit portion provided on one end side of the antenna and the top plate portion of the shield cover are connected by the short-circuit plate portion, and the attachment portion for attachment to a product to which the wireless communication device is applied is included in the shield cover. Therefore, the short-circuit portion of the antenna is connected to a ground of a product to which the wireless communication device is applied, through the top plate portion and the attachment portion of the shield cover. Thus, the ground of the antenna is enhanced unlike in the case of connection to the ground through a board (circuit board) of the example of the related art. Thus, the configuration is simple, the ground of antenna is stabilized, and improvement of the antenna performance can be achieved.

In the wireless communication device of the present embodiments, the shield cover may include a plurality of side plates provided integrally with the top plate portion, and side surfaces of the shield cover may be formed of the plurality of side plates in a portion other than a portion in which the short-circuit plate portion is provided.

Accordingly, in a wireless communication device of the present embodiments, since the side surfaces of the shield cover are formed of a plurality of side plates provided integrally with the top plate portion in the portion other than the portion in which the short-circuit plate portion has been provided, the sides and the top of the wireless communication main body can be covered without a joint. This makes it possible to improve a shielding effect, block interfering radio waves from the outside, and prevent unnecessary radiation to the outside.

In a wireless communication device of the present embodiments, the attachment portion may be provided on a distal end side of the side plate, and a hole portion into which a metal screw is inserted may be provided in the attachment portion.

Accordingly, in the wireless communication device of the present embodiments, since the hole portion into which a metal screw is inserted is provided in the attachment portion, the wireless communication device can be simply attached to a product main body by the metal screw, and reliably connected to a ground of the product. Further, by adjusting, for example, a connection angle between the side plate and the attachment portion or a folding angle of the attachment portion, it is possible to freely set the angle of attachment of the wireless communication device of the present invention to the product main body, and to achieve improvement of applicability to the product.

In a wireless communication device of the present embodiments, the antenna main body may be folded.

Accordingly, in the wireless communication device of the present embodiments, since the antenna main body portion is folded, it is possible to change the antenna directivity of the antenna and improve the antenna performance. For example, even when an installation place of the wireless communication device is changed from an initial plan and the communication performance deteriorates, the antenna is folded to change the antenna directivity, and thus, it is possible to ensure the communication performance.

In a wireless communication device of the present embodiments, the antenna main body and the top plate portion may be arranged on the same surface.

Accordingly, in the wireless communication device of the present embodiments, since the antenna main body portion and the top plate portion are arranged on the same surface, a distance between the antenna main body portion and the circuit board can be maximally increased without increasing the total thickness of the wireless communication device. Therefore, influence of the circuit board formed of a dielectric material (for example, epoxy resin) that may have influence on the directivity of the antenna is small, and thus, it is possible to improve antenna characteristics.

BRIEF DESCRIPTION OF THE DRAWINGS

FIG. 2A is a plan view viewed from a Z1 side illustrated in FIG. 1, and FIG. 2B is a side view viewed from a Y2 side illustrated in FIG. 1;

FIG. 7A is a perspective view of the wireless device, FIG. 7B is a plan view illustrating one metal plate, and FIG. 7C is a perspective view illustrating a state in which a processed metal plate is mounted on a board.

DETAILED DESCRIPTION OF THE DISCLOSURE

The following description is intended to convey a thorough understanding of the embodiments described by providing a number of specific embodiments and details involving a wireless communication apparatus. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs.

Hereinafter, a wireless communication device 100 according to an example embodiment will be described with reference to FIGS. 1 to 5.

Figure 1:
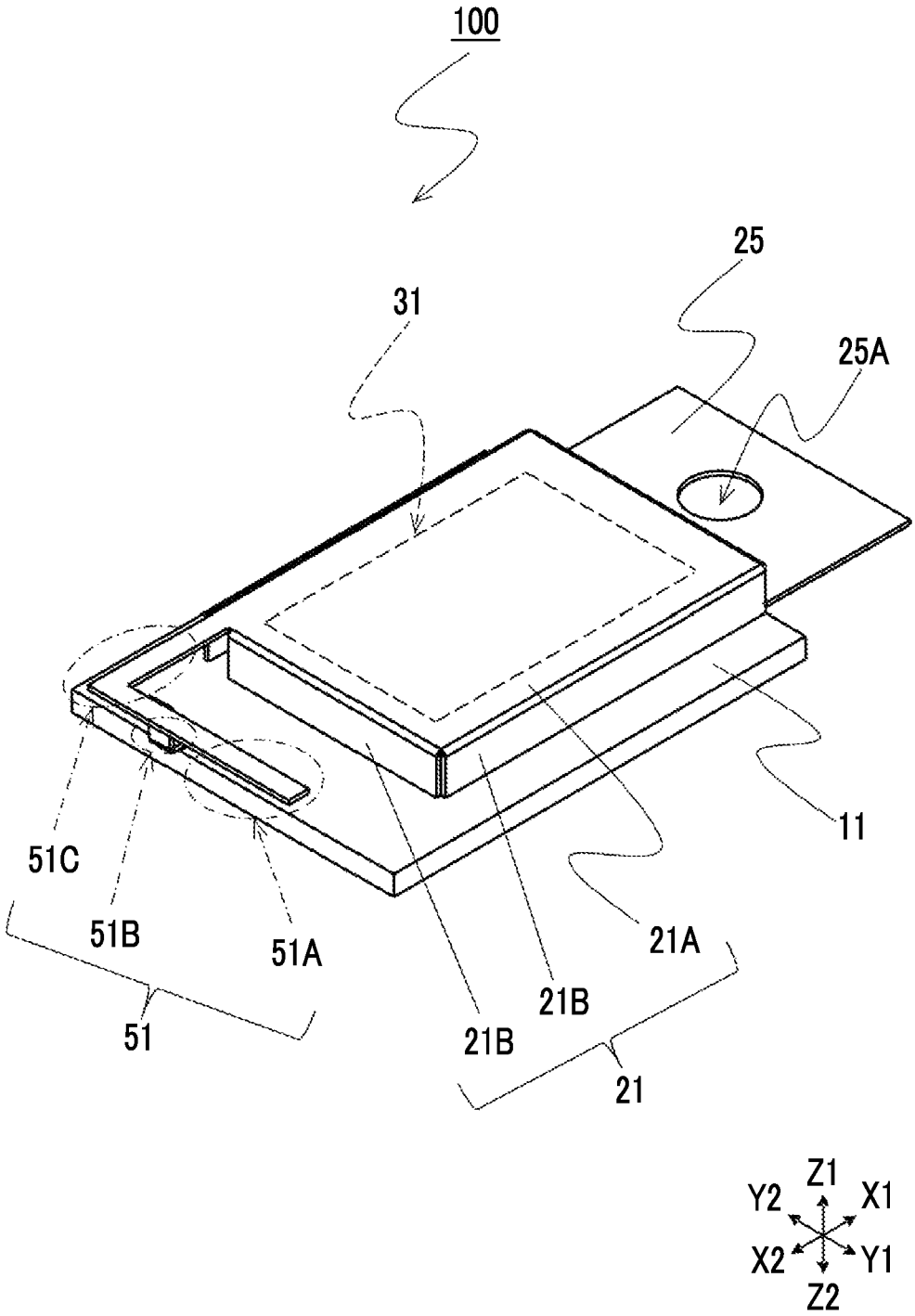
FIG. 1 is a perspective view illustrating a wireless communication device according to an example embodiment of the present disclosure.

The wireless communication device 100 may have a rectangular shape as illustrated in FIG. 1. The wireless communication device 100 may include a circuit board 11 having a pattern (not shown) formed on a surface thereof, a wireless communication main body 31 arranged on one surface of the circuit board 11, for performing wireless communication, a shield cover 21 that covers and shields the wireless communication main body 31 arranged on one surface of the circuit board 11, and an antenna 51 connected to the wireless communication main body 31, as illustrated in FIGS. 1 and 2.

First, the circuit board 11 of the wireless communication device 100 may have a thick plate shape which may be a rectangular shape, as illustrated in FIG. 1. Further, the circuit board 11 may include a pattern formed of a thin copper electrode (copper foil), and a multilayer plate in which, for example, several glass epoxy resin layers having a good electric insulation property may be folded as a base material, or a double-sided plate in which a pattern formed of a copper foil on one surface and the other surface of a glass epoxy resin layer or the like is provided.

Figure 2A:
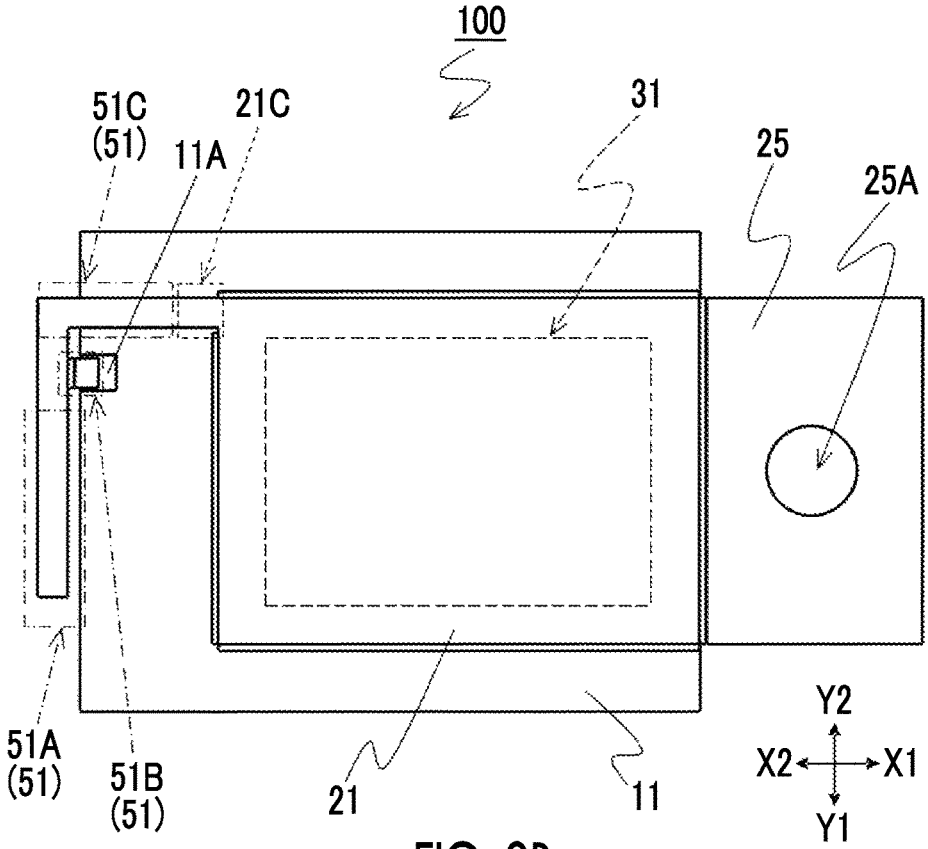
FIGS. 2A and 2B are views illustrating the wireless communication device according to an example embodiment of the present disclosure.

Further, the wireless communication main body 31 indicated by a dotted line, the shield cover 21 that covers the wireless communication main body 31, and the antenna 51 connected to the wireless communication main body 31 may be arranged on the one surface of the circuit board 11, as illustrated in FIG. 1. Also, a pattern (not shown) for electrical connection to each of the wireless communication main body 31, the shield cover 21, and the antenna 51 may be formed on the one surface of the circuit board 11. Further, within the pattern, only a feed land 11A connected to a portion (feed portion 51B to be described below) of the antenna 51 by soldering or the like is illustrated in FIG. 2A. Further, the wireless communication main body 31 and the antenna 51 may be electrically connected through this feed land 11A.

Next, the wireless communication main body 31 of the wireless communication device 100 may be arranged on one surface of the circuit board 11, as described above, and a circuit may be formed of electronic parts for performing wireless communication through the antenna 51. This circuit may include a transmission circuit for transmitting a radio signal, and a reception circuit for receiving the radio signal. Also, in this circuit, impedance of the wireless communication main body 31 viewed from the feed land 11A side is matched to 50Ω, and impedance of the feed portion 51B of the antenna 51 is matched to 50Ω. Accordingly, it is possible to efficiently exchange a radio signal between the wireless communication main body 31 and the antenna 51.

The transmission circuit of the wireless communication main body 31 converts transmission data into a radio signal and sends the radio signal to the antenna 51. In this case, the level of the radio signal may be high so as to send the radio signal a long distance. For this reason, electromagnetic waves (radio waves) generated by the wireless communication main body 31 may leak to an external electronic device (unnecessary radiation to the outside).

The reception circuit of the wireless communication main body 31 may receive weak radio waves from a communication partner through the antenna 51, and convert a received radio signal into reception data. In this case, electromagnetic waves (radio waves) intruding from an external electronic device may interfere with the reception circuit (interfering radio waves from the outside).

Figure 2B:
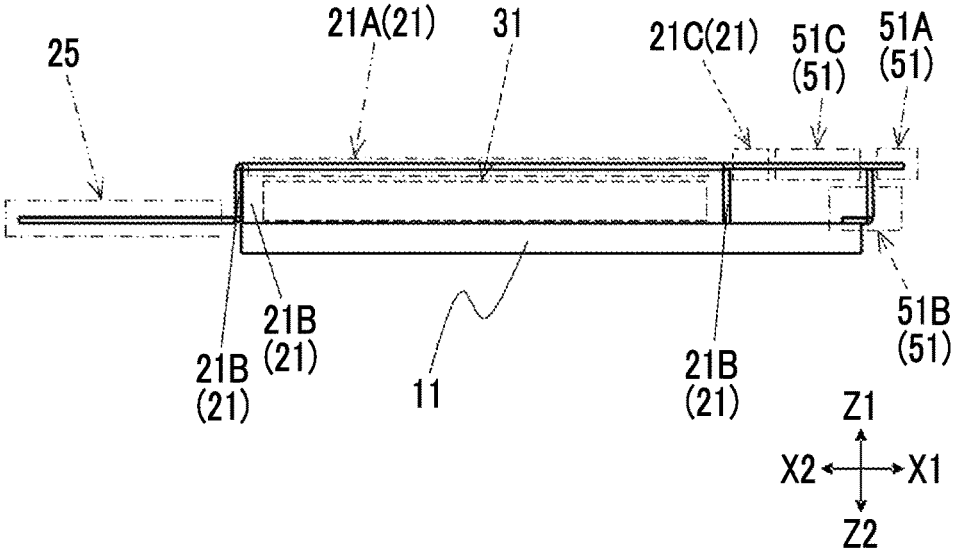

Next, the shield cover 21 of the wireless communication device 100 may include a top plate portion 21A that has a box shape and faces the wireless communication main body 31, four side plates 21B provided integrally with the top plate portion 21A, and a short-circuit plate portion 21C that extends in the same surface from the top plate portion 21A, as illustrated in FIGS. 1 and 2B. Also, the shield cover 21 may be arranged to prevent electromagnetic waves generated by the wireless communication main body 31 from leaking to the external electronic device (unnecessary radiation to the outside), to shield electromagnetic waves (interfering radio waves from the outside) intruding from the external electronic device to the wireless communication main body 31, and to cover the entire area of the wireless communication main body 31. Further, although not illustrated in detail, the side plates 21B of the shield cover 21 and the pattern for connection to a ground of the circuit board 11 may be connected by soldering or the like for reliable shielding of the wireless communication main body 31.

The top plate portion 21A of the shield cover 21 may be formed in a rectangular shape as illustrated in FIG. 1, and is arranged to cover the entire area of the wireless communication main body 31 and to face the wireless communication main body 31 arranged on one surface of the circuit board 11 as illustrated in FIG. 2B.

The side plates 21B of the shield cover 21 constitute side surfaces of the shield cover 21. The side plates 21B may extend downward (in a Z2 direction in FIG. 1) from four end portions of the top plate portion 21A, and may be formed integrally with the top plate portion 21A in a portion other than a portion in which the short-circuit plate portion 21C has been provided, as illustrated in FIGS. 1 and 2B. Further, the four side plates 21B may have a slightly greater height than an electronic part having the greatest height among electronic parts constituting the wireless communication main body 31, to achieve a small thickness of the wireless communication device 100. Therefore, in the wireless communication device 100, since the side surfaces of the shield cover 21 are formed of the four side plates 21B provided integrally with the top plate portion 21A in the portion other than the portion in which the short-circuit plate portion 21C has been provided, the sides and the top of the wireless communication main body 31 can be covered without a joint. This makes it possible to improve a shielding effect, prevent interfering radio waves from intruding from the outside, and prevent unnecessary radiation to the outside.

The short-circuit plate portion 21C of the shield cover 21 may connect the antenna 51 (short-circuit portion 51C to be described below) to the top plate portion 21A of the shield cover 21, as illustrated in FIGS. 2A and 2B. Further, the short-circuit plate portion 21C may be formed to the same width as the antenna 51 (short-circuit portion 51C to be described below).

Next, the antenna 51 of the wireless communication device 100 may be an inverted F-antenna including an antenna main body portion 51A, a feed portion 51B, and a short-circuit portion 51C, as illustrated in FIG. 2A. This inverted F-antenna may be formed in a reversed letter F shape, and is one ground antenna that operates by setting one of elements of the antenna 51 to a ground.

Further, the short-circuit portion 51C provided on one end of the antenna 51 and the top plate portion 21A of the shield cover 21 facing the wireless communication main body 31 may be connected by the short-circuit plate portion 21C. The feed portion 51B of the antenna 51 may be connected to the feed land 11A formed on the surface of the circuit board 11. Further, the antenna main body portion 51A and the top plate portion 21A are arranged on the same surface, as illustrated in FIGS. 1 and 2B. Therefore, in the wireless communication device 100, since the antenna main body portion 51A and the top plate portion 21A are arranged on the same surface, a distance between the antenna main body portion 51A and the circuit board 11 can be maximally increased without increasing the total thickness of the wireless communication device 100. Therefore, influence from the circuit board 11 formed of a dielectric material (for example, epoxy resin) that may have influence on the directivity of the antenna 51 is small, and thus, it is possible to improve antenna characteristics.

The antenna main body portion 51A of the antenna 51 may be a primary element that determines antenna characteristics. Further, the antenna main body portion 51A efficiently converts (transmits) the radio signal from the wireless communication main body 31 into radio waves through the feed portion 51B. Further, the antenna main body portion 51A efficiently converts (receives) weak radio waves transmitted from the outside into a radio signal and sends the radio signal to the wireless communication main body 31. That is, the antenna main body portion 51A may be reversible, and has transmission and reception functions.

Figure 3:
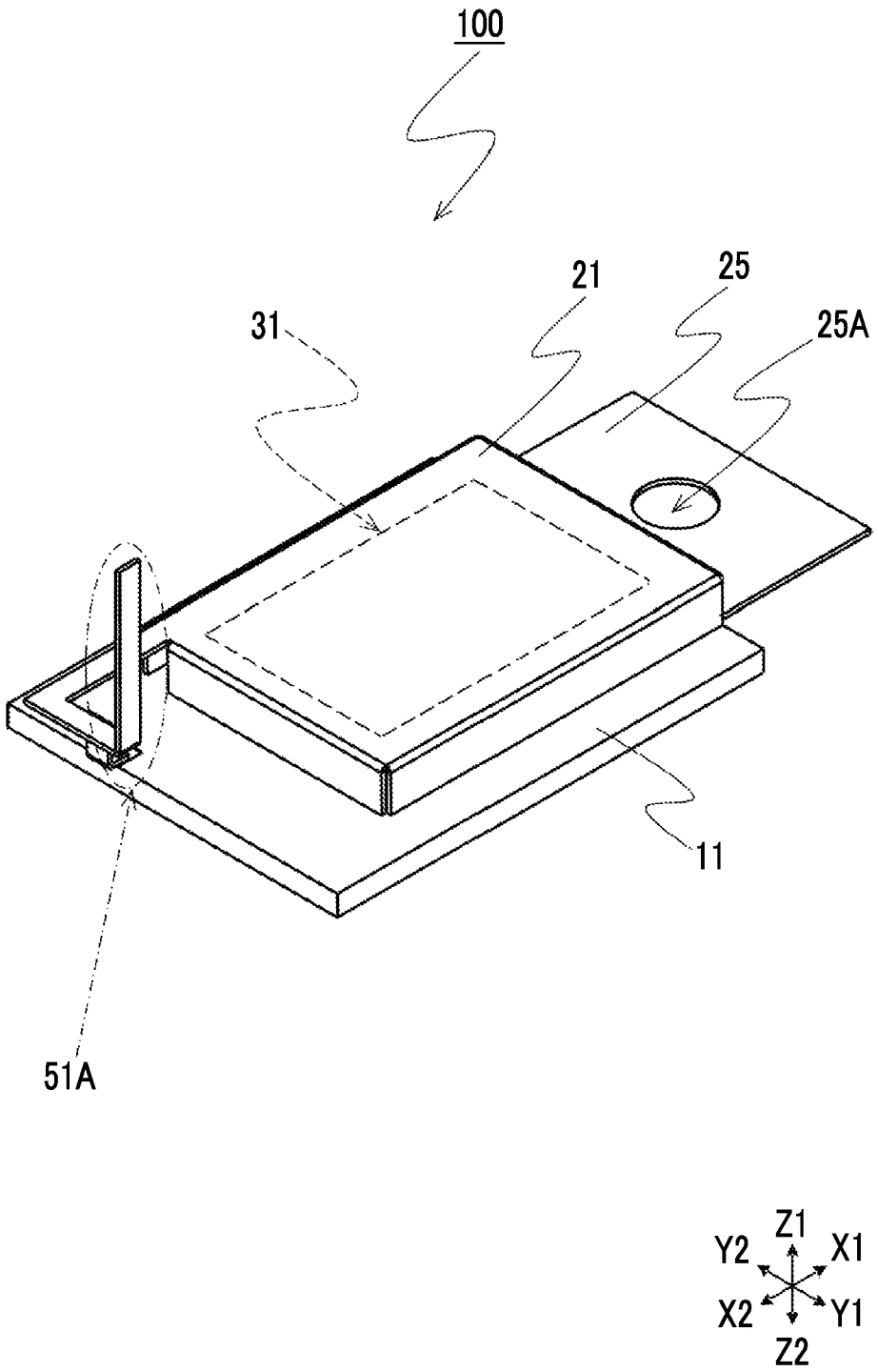
FIG. 3 is a perspective view illustrating an example of usage of the wireless communication device according to an example embodiment of the present disclosure.

Further, the antenna main body portion 51A can be folded, as in an example illustrated in FIG. 3. This makes it possible to change antenna directivity that is one of the antenna characteristics, and to improve antenna performance. For example, even when an installation place of the wireless communication device 100 is changed from an initial plan and communication performance deteriorates, the antenna 51 may be folded to change the antenna directivity, and thus, it may be possible to ensure the communication performance. Further, since there is such a usage, the wireless communication device 100 is convenient.

The feed portion 51B of the antenna 51 may be formed with impedance matched to 50Ω, and connected to the wireless communication main body 31 through the feed land 11A formed on one surface of the circuit board 11. Accordingly, the antenna 51 efficiently exchanges a radio signal with the wireless communication main body 31.

The short-circuit portion 51C of the antenna 51 may be formed to be connected to the ground, and causes the antenna 51 to operate as an antenna. Since the antenna 51 is a ground antenna, improvement and stabilization of the antenna characteristics can be achieved when the wireless communication device 100 has a configuration in which the short-circuit portion 51C is strongly connected to the ground.

Figure 4:
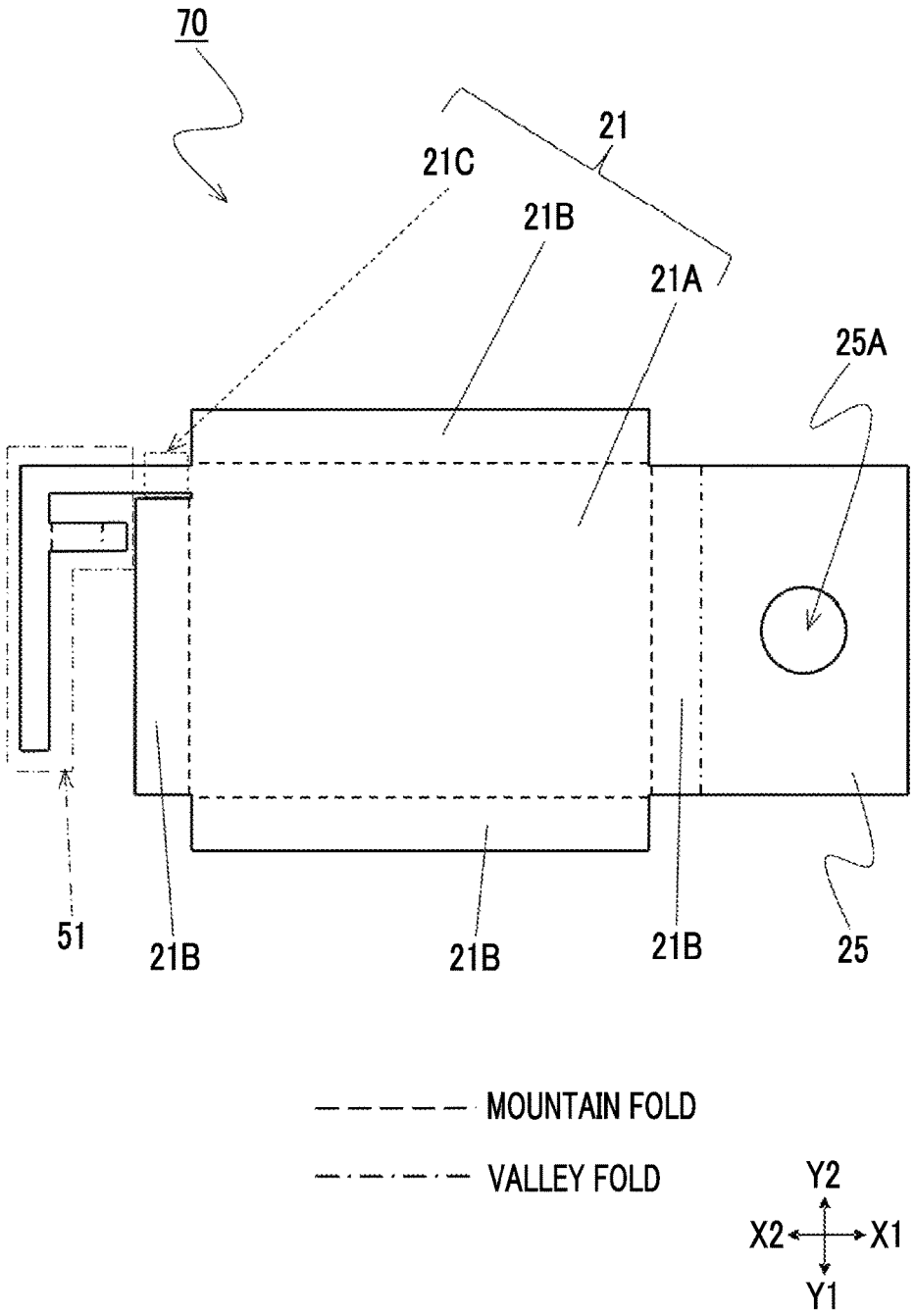
FIG. 4 is a plan view illustrating a metal plate used for manufacturing the wireless communication device according to an example embodiment of the present disclosure.

Here, a method of manufacturing the shield cover 21 and the antenna 51 of the wireless communication device 100 will be briefly described with reference to FIG. 4. FIG. 4 is a plan view illustrating a metal plate used in the wireless communication device 100 according to the first embodiment of the present invention.

In the method of manufacturing the shield cover 21 and the antenna 51, first, a punching process may be performed on one metal plate using a mold to obtain an outer shape as illustrated in FIG. 4, and to manufacture a processed sheet 70. Here, a copper-based metal material (for example, nickel silver) having high conductivity is used as the metal plate. Further, use of the material having high conductivity as this metal material is intended to achieve improvement of shield performance of the shield cover 21 and improvement of antenna performance of the antenna 51.

Next, a bending process may be performed on this processed sheet 70 along a mountain fold line (dotted line) and a valley fold line (one-dot chain line) illustrated in FIG. 4 to form the three-dimensional shield cover 21 and the three-dimensional antenna 51 as illustrated in FIG. 1. Thus, it is possible to manufacture the shield cover 21 and the antenna 51 through a simple process.

Further, since the shield cover 21 and the antenna 51 is formed as one metal plate, and the feed portion 51B of the antenna 51 may be folded and connected to the feed land 11A of the circuit board 11 as described above, the shield cover 21 and the antenna 51 can be attached to the circuit board 11 as one part. Therefore, it is not necessary to use a method of cutting the shield case 903 and the sheet metal antenna 902 after attachment to the board 901 as in the example of the related art. Thus, in the example embodiments, it is possible to manufacture the shield cover 21 and the antenna 51 through a simpler process.

Further, in the example embodiments, it is not necessary to cut the shield cover 21 and the antenna 51, and it is possible to attach the shield cover 21 and the antenna 51 to the circuit board 11 as a single part. Therefore, it is possible to prevent the antenna performance from deteriorating due to deformation of the antenna 51 at the time of cutting.

Further, since the top plate portion 21A of the shield cover 21, the antenna main body portion 51A and the short-circuit portion 51C of the antenna 51 are the same surface, there is no extra folding performed. Thus, it is possible to easily manufacture the shield cover 21 and the antenna 51.

Finally, an attachment portion 25 of the wireless communication device 100 is provided for attachment to the product to which the wireless communication device 100 is applied, formed to be continuous to a distal end of the side plate 21B of the shield cover 21 as illustrated in FIG. 2B, and manufactured integrally with the shield cover 21 as illustrated in FIG. 4.

Further, a hole portion 25A having a circular shape may be provided in a central portion of the attachment portion 25, as illustrated in FIGS. 1 and 2A. When the wireless communication device 100 is applied to a product, a metal screw may be inserted into the hole portion 25A, and the wireless communication device 100 can be simply and reliably attached to the product.

Further, the attachment portion 25 may be connected to a ground of the product to which the wireless communication device 100 is applied, through the metal screw. That is, the antenna 51 is connected to the short-circuit plate portion 21C of the shield cover 21, and connected to the ground of the product to which the wireless communication device 100 is applied, through the shield cover 21 and the attachment portion 25. Therefore, the ground of the antenna 51 may be enhanced unlike in connection to the ground through the board 901 in the example of the related art. Thus, the configuration is simple, and the ground of antenna 51 is stabilized. Improvement of the antenna performance can be achieved.

Further, since the side plate 21B of the shield cover 21 formed integrally with the attachment portion 25 may be soldered to the pattern of the circuit board 11 as described above, attachment strength between the wireless communication device 100 and the product to which the wireless communication device 100 is applied becomes high.

Figure 5:
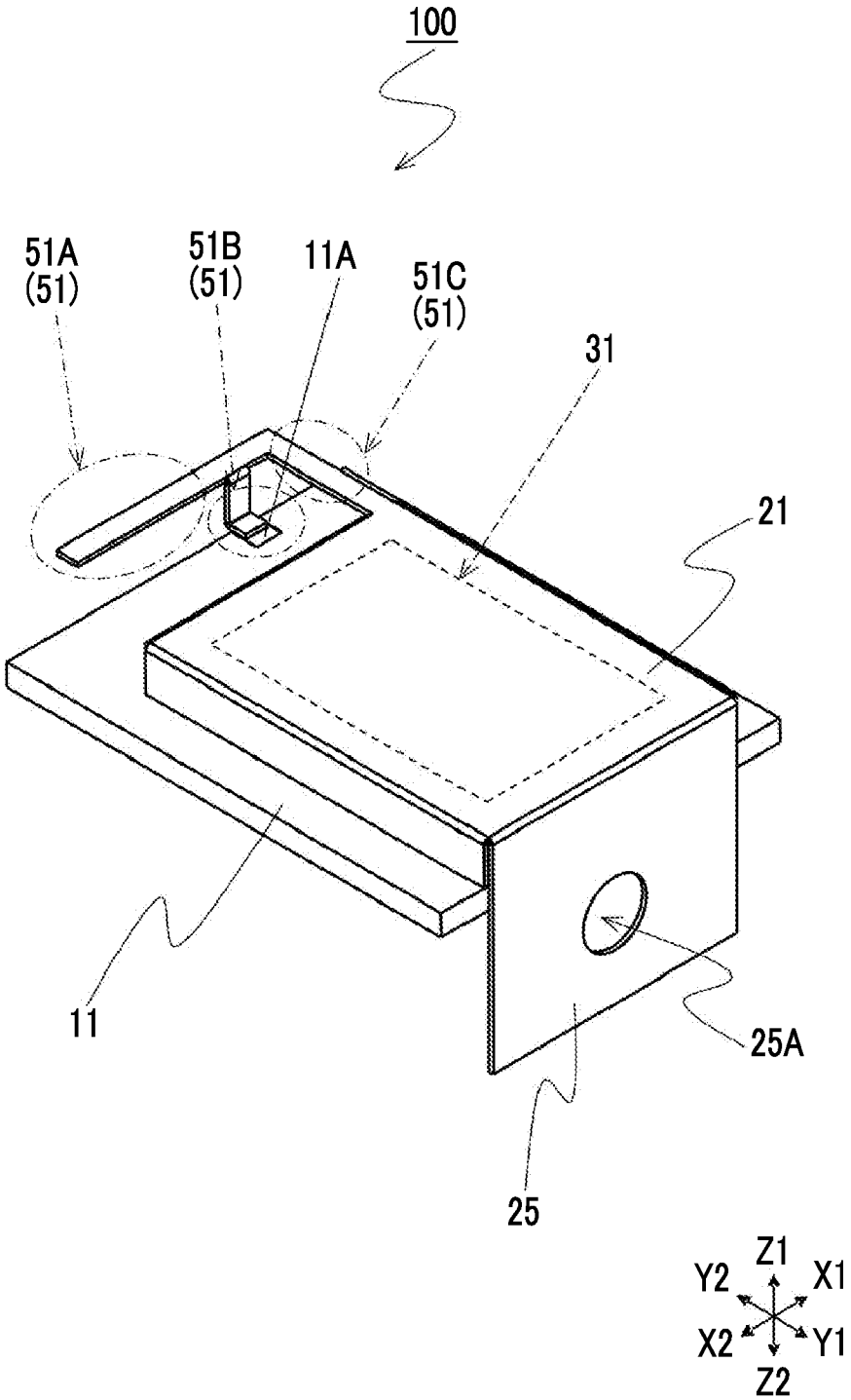
FIG. 5 is a perspective view illustrating an example of usage of the wireless communication device according to an example embodiment of the present disclosure.

Further, the attachment portion 25 can be folded as in an example illustrated in FIG. 5. Accordingly, it may be possible to freely change an angle of attachment of the wireless communication device 100 to the product main body, and for example, to change the direction of the antenna 51 so as to ensure communication performance or avoid interference with another part. Thus, it is possible to achieve improvement of applicability to the product. Since there is such a usage, the wireless communication device 100 is convenient.

In the wireless communication device 100, the short-circuit portion 51C provided on one end side of the antenna 51 and the top plate portion 21A of the shield cover 21 may be connected by the short-circuit plate portion 21C, and the attachment portion 25 for attachment to a product to which the wireless communication device 100 is applied is included in the shield cover 21. Therefore, the short-circuit portion 51C of the antenna 51 may be connected to a ground of the product to which the wireless communication device 100 is applied, through the top plate portion 21A and the attachment portion 25 of the shield cover 21. Thus, the ground of the antenna 51 may be further enhanced as compared to connection to the ground through the board 901 (circuit board 11) in the example of the related art. Thus, the configuration is simple, and the ground of antenna 51 may be stabilized. Improvement of the antenna performance can be achieved.

Further, since the side surface of the shield cover 21 is formed of a plurality of side plates 21B provided integrally with the top plate portion 21A in a portion other than the portion in which the short-circuit plate portion 21C has been provided, the side and the top of the wireless communication main body 31 can be covered without a joint. Thus, it is possible to improve the shielding effect, shield (interference) electromagnetic waves from the outside, and prevent leakage of (interference) electromagnetic waves to the outside.

Further, since the hole portion 25A into which a metal screw is inserted is provided in the attachment portion 25, the wireless communication device 100 can be simply attached to a product main body with the metal screw, and reliably connected to the ground of the product. Further, by adjusting, for example, a connection angle between the side plate 21B and the attachment portion 25 or a folding angle of the attachment portion 25, it may be possible to freely set the angle of attachment of the wireless communication device 100 of the present invention to the product main body, and to achieve improvement of applicability to the product.

Further, since the antenna main body portion 51A is folded, it is possible to change the antenna directivity of the antenna 51 and improve the antenna performance. For example, even when an installation place of the wireless communication device 100 is changed from an initial plan and the communication performance deteriorates, the antenna 51 may be folded to change the antenna directivity, and thus, it is possible to ensure the communication performance.

Further, since the antenna main body portion 51A and the top plate portion 21A are arranged on the same surface, a distance between the antenna main body portion 51A and the circuit board 11 can be maximally increased without increasing a total thickness of the wireless communication device 100. Therefore, influence of the circuit board 11 formed of a dielectric material (for example, epoxy resin) that may have influence on the directivity of the antenna is small, and thus, it is possible to improve antenna characteristics.

While the wireless communication device 100 according to the example embodiment has been specifically described above, the present invention is not limited to the above embodiment, and can be variously modified and implemented without departing from the gist of the invention. For example, the present invention may be modified and implemented as follows, and such embodiments belong to the technical scope of the present invention.

In an example embodiment, the attachment portion 25 has been one metal plate and has been appropriately manufactured integrally with the shield cover 21 and the antenna 51, but the present invention is not limited thereto. For example, the attachment portion 25 may be soldered to the top plate portion 21A of the shield cover 21.

Also, while one antenna 51 is provided in the wireless communication device 100, a plurality of antennas may be provided.

While the hole portion 25A of the attachment portion 25 has a structure subjected to round hole processing, a tapping process (carving a screw on the inside of a round hole) may be performed on the hole portion 25A.

Figure 6:
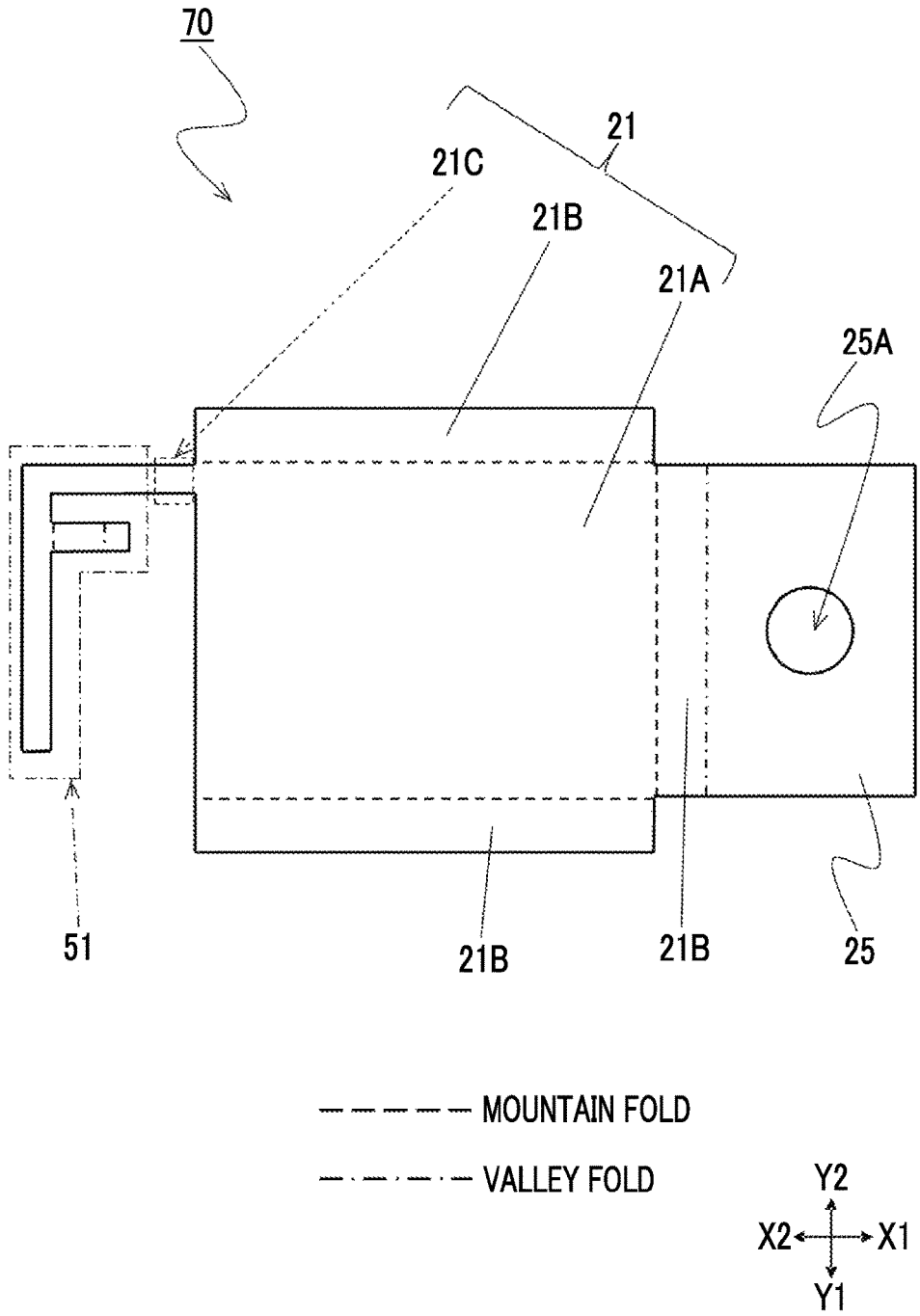
FIG. 6 is a view illustrating a modification example of the wireless communication device according to an example embodiment of the present disclosure, and is a plan view of a metal plate used for manufacturing a wireless communication device of modification example 4.
Figure 7A:
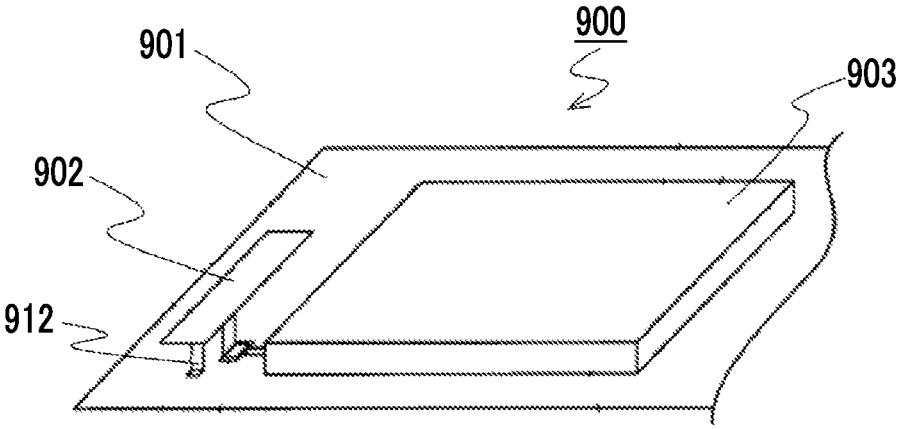
FIG. 7A PRIOR ART
FIGS. 7A to 7C are views illustrating a wireless device in an example of the related art.
Figure 7B:
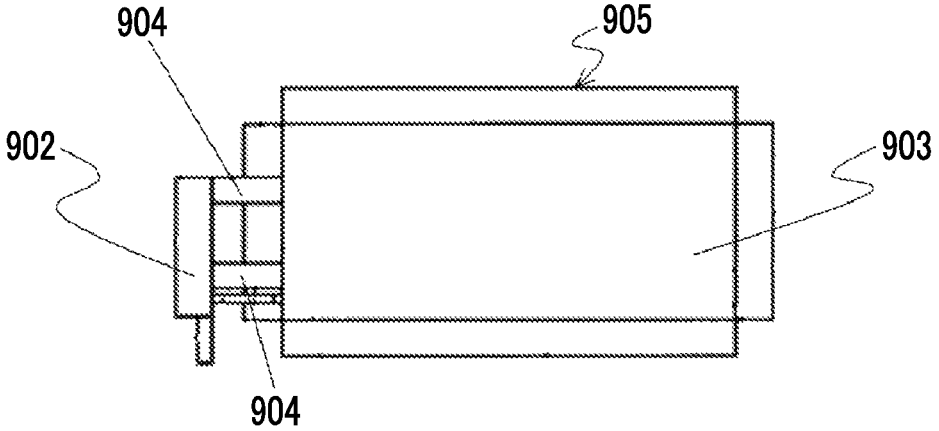
FIG. 7B PRIOR ART
Figure 7C:
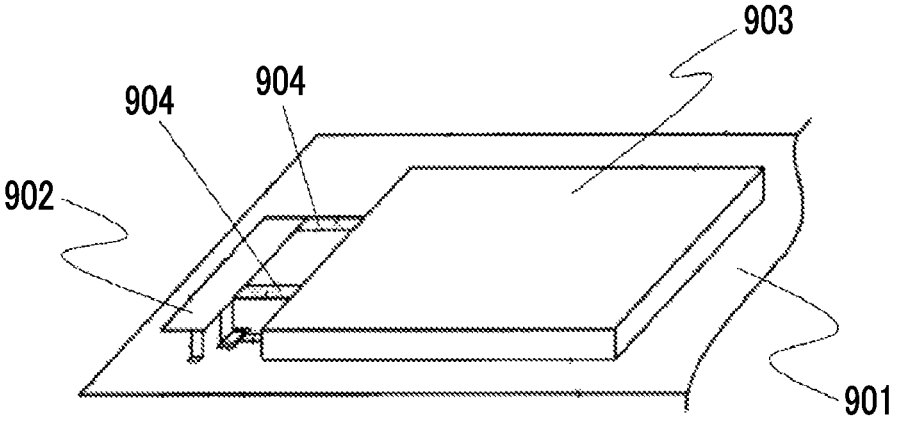
FIG. 7C PRIOR ART

Also, the shield cover 21 may be formed of the plurality of side plates 21B in the portion other than the portion in which the short-circuit plate portion 21C has been provided (see FIG. 4), but the present invention is not limited thereto. For example, a portion in which the side plate 21B is not formed may be in the portion other than the portion in which the short-circuit plate portion 21C has been provided, as shown in FIG. 6.

Modification Example 5

The top plate portion 21A of the shield cover 21 and the antenna main body portion 51A of the antenna 51 are arranged on the same surface, but the present invention is not limited thereto. For example, the antenna 51 may be arranged to be further away from the circuit board 11 so as to further reduce influence from the circuit board 11 that is a dielectric material.

Modification Example 6

The circuit board 11 includes the pattern formed of a copper foil and the glass epoxy resin layer, the circuit board 11 may include a pattern formed by printing and sintering a silver paste, and a low temperature co-fired ceramics (LTCC).

It should be understood by those skilled in the art that various modifications, combinations, sub-combinations and alterations may occur depending on design requirements and other factors insofar as they are within the scope of the appended claims of the equivalents thereof.

Accordingly, the embodiments of the present inventions are not to be limited in scope by the specific embodiments described herein. Further, although some of the embodiments of the present disclosure have been described herein in the context of a particular implementation in a particular environment for a particular purpose, those of ordinary skill in the art should recognize that its usefulness is not limited thereto and that the embodiments of the present inventions can be beneficially implemented in any number of environments for any number of purposes. Accordingly, the claims set forth below should be construed in view of the full breadth and spirit of the embodiments of the present inventions as disclosed herein. While the foregoing description includes many details and specificities, it is to be understood that these have been included for purposes of explanation only, and are not to be interpreted as limitations of the invention. Many modifications to the embodiments described above can be made without departing from the spirit and scope of the invention.

What is claimed is:

1. A wireless communication device, comprising:

a circuit board having a pattern formed on a surface thereof;

a wireless communication main body which is an electrical circuit configured to perform wireless communication and includes electrical components arranged on the surface of the circuit board;

a shield cover that includes a top plate portion facing the wireless communication main body, and plurality of side plate portions extending from the top plate portion to the surface of the circuit board, so as to form side surfaces of the shield cover and is configured to cover and shield the wireless communication main body arranged on the one surface of the circuit board; and an antenna that is an inverted F-antenna connected to the wireless communication main body and includes a main antenna portion, a feed portion connected to a feed land formed on the surface of the circuit board, and a short-circuit portion extending from the top plate portion of the shield cover; and an attachment that is attached to a product to which wireless communication device is applied and includes a bottom plate portion extending from a distal end side of the side plate, wherein the shield cover and the antenna and the attachment are made integrally with one metal plate.

2. The wireless communication device according to claim 1, wherein the attachment includes a hole portion provided in the bottom plate portion into which a metal screw is inserted.

3. The wireless communication device according to claim 1, wherein the main antenna portion is folded.

4. The wireless communication device according to claim 1, wherein the main antenna portion and the top plate portion are arranged on the same surface.

* * * * *